US012729918B2

(12) United States Patent
He et al.

(10) Patent No.: US 12,729,918 B2
(45) Date of Patent: Sep. 8, 2026

(54) WICK STRUCTURE FOR THIN HEATPIPES

(71) Applicant: Dell Products L.P., Round Rock, TX (US)

(72) Inventors: Qinghong He, Austin, TX (US); Travis C. North, Cedar Park, TX (US)

(73) Assignee: Dell Products L.P., Round Rock, TX (US)

( * ) Notice: Subject to any disclaimer, the term of this patent is extended or adjusted under 35 U.S.C. 154(b) by 154 days.

(21) Appl. No.: 18/484,669

(22) Filed: Oct. 11, 2023

(65) Prior Publication Data

US 2025/0123059 A1 Apr. 17, 2025

(51) Int. Cl.
*F28D 15/04* (2006.01)
*F28D 21/00* (2006.01)

(52) U.S. Cl.
CPC .... *F28D 15/046* (2013.01); *F28D 2021/0029* (2013.01)

(58) Field of Classification Search
CPC ..... F28D 15/04; F28D 15/046; F28D 2021/0029; H01L 23/427; H05K 7/20336
See application file for complete search history.

(56) References Cited

U.S. PATENT DOCUMENTS 3,901,311 A * 8/1975 Kosson ..... F28D 15/046 138/40
6,679,318 B2 * 1/2004 Bakke ..... F28D 15/0233 174/15.2
6,997,245 B2 * 2/2006 Lindemuth ..... F28D 15/046 165/104.21
9,074,824 B2 * 7/2015 Wu ..... F28D 15/0233
2010/0266864 A1 * 10/2010 Lee ..... B22F 7/08 428/553
2015/0101192 A1 * 4/2015 Pai ..... F28D 15/046 29/890.032
2016/0353610 A1 * 12/2016 Chan ..... F28D 15/04
2018/0172360 A1 * 6/2018 Miura ..... H01L 23/427

FOREIGN PATENT DOCUMENTS

CN 111414056 A * 7/2020 ..... B22F 3/004
JP 2002318085 A * 10/2002 ..... F28D 15/046
KR 102501074 B1 * 2/2023 ..... H05K 7/20

OTHER PUBLICATIONS

KR-102501074 with English text translation (Year: 2023).*

* cited by examiner

*Primary Examiner* — Tho V Duong

(74) *Attorney, Agent, or Firm* — McDermott Will & Schulte LLP

(57) ABSTRACT

In one or more embodiments, a thin heatpipe may comprise a tube with a wick formed as a plurality of longitudinal ridges, each ridge in contact with a first portion of an inner surface corresponding to a first side of the tube and extending to contact a portion of the inner surface associated with an opposite side of the tube. The ridges may divide the interior of the tube into a plurality of vapor cavity areas.

7 Claims, 7 Drawing Sheets

WICK STRUCTURE FOR THIN HEATPIPES

BACKGROUND

Field of the Disclosure

This disclosure relates generally to cooling information handling systems and more particularly to thin heatpipes for cooling components in a chassis of an information handling system.

Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

SUMMARY

Embodiments may be directed to a heatpipe comprising a hollow tube forming a vapor cavity, wherein the tube comprises two opposing sides; a wick formed in the tube, the wick comprising a plurality of ridges, each ridge formed longitudinally on an inner surface of the tube and comprising a base in contact with a first portion of the inner surface and one or more sides extending for contact with a second portion of the inner surface, wherein the first portion is associated with a first side of the tube and the second portion is associated with a second side of the tube opposite the first side and the plurality of ridges divides an interior of the tube into a plurality of vapor cavity areas; and a working fluid in the plurality of vapor cavity areas.

In some embodiments, a ridge of the plurality of ridges comprises a rectilinear cross-section profile. In some embodiments, the ridge of the plurality of ridges comprises a triangular cross-section profile. In some embodiments, a ridge of the plurality of ridges comprises a curvilinear cross-section profile. In some embodiments, a ridge of the plurality of ridges is in contact with an adjacent ridge of the plurality of ridges. In some embodiments, a ridge of the plurality of ridges is separated from an adjacent ridge of the plurality of ridges by a gap. In some embodiments, the plurality of ridges are formed by sintering the wicking material.

Embodiments may be directed to a method of forming a heatpipe for use in a chassis of an information handling system. The method may comprise positioning a mandrel in an interior of a tube, the mandrel having an outer surface comprising a first portion that is generally continuous and a second portion comprising a plurality of longitudinal indentations, wherein the plurality of longitudinal indentations and an inner surface of the tube form a plurality of longitudinal cavities; adding a wicking material in the longitudinal cavities; heating the mandrel and the tube, wherein the wicking material forms a plurality of ridges based on a shape of the plurality of cavities; removing the mandrel from the tube; compressing the tube to configure the tube with two sides, wherein each ridge of the plurality of ridges has a base in contact with a first portion of the inner surface associated with a first side of the two sides and each ridge extends for contact with a portion of the inner surface associated with a second side of the two sides, the plurality of ridges dividing the interior of the tube into a plurality of vapor cavity areas; adding a working fluid in the tube; and sealing the tube.

In some embodiments, a ridge of the plurality of ridges comprises a rectilinear cross-section profile. In some embodiments, the ridge of the plurality of ridges comprises a triangular cross-section profile. In some embodiments, a ridge of the plurality of ridges comprises a curvilinear cross-section profile. In some embodiments, a ridge of the plurality of ridges is in contact with an adjacent ridge of the plurality of ridges. In some embodiments, a ridge of the plurality of ridges is separated from an adjacent ridge of the plurality of ridges by a gap. In some embodiments, the method comprises sintering the wicking material to form the plurality of ridges.

Embodiments may be directed to a cooling system for an information handling system. The cooling system may comprise a heat exchanger; and a heatpipe having a first end thermally coupled to a heat-generating component of the information handling system and a second end thermally coupled to the heat exchanger. The heatpipe may comprise a hollow tube with an inner surface, wherein the tube is flattened to form two opposing sides; a wick formed in the tube, the wick comprising a plurality of ridges, each ridge formed longitudinally within the tube and comprising a base in contact with a portion of the inner surface associated with a first side of the two sides and each ridges extends to contact a portion of the inner surface associated with a second side of the two sides, the plurality of ridges dividing an interior of the tube into a plurality of vapor cavity areas; and a working fluid in the plurality of vapor cavity areas.

In some embodiments, a ridge of the plurality of ridges comprises a rectilinear cross-section profile. In some embodiments, the ridge of the plurality of ridges comprises a triangular cross-section profile. In some embodiments, a ridge of the plurality of ridges comprises a curvilinear cross-section profile. In some embodiments, a ridge of the plurality of ridges is in contact with an adjacent ridge of the plurality of ridges. In some embodiments, a ridge of the plurality of ridges is separated from an adjacent ridge of the plurality of ridges by a gap.

BRIEF DESCRIPTION OF THE DRAWINGS

For a more complete understanding of the present disclosure and its features/advantages, reference is now made to the following description, taken in conjunction with the accompanying drawings, which are not drawn to scale, and in which.

DETAILED DESCRIPTION

Figure 1:
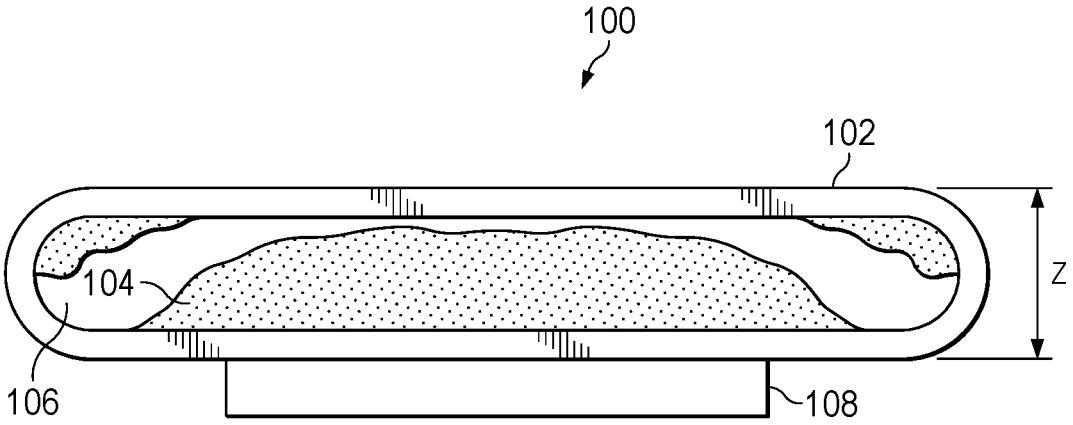
FIG. 1 depicts an example heatpipe with a wick formed in contact with a first side of a tube, illustrating an occurrence in which heat in the middle of the wick may be forced to travel some distance to reach a vapor cavity.

In the following description, details are set forth by way of example to facilitate discussion of the disclosed subject matter. It should be apparent to a person of ordinary skill in the field, however, that the disclosed embodiments are examples and not exhaustive of all possible embodiments.

As used herein, a reference numeral refers to a class or type of entity, and any letter following such reference numeral refers to a specific instance of a particular entity of that class or type. Thus, for example, a hypothetical entity referenced by '12A' may refer to a particular instance of a particular class/type, and the reference '12' may refer to a collection of instances belonging to that particular class/type or any one instance of that class/type in general.

An information handling system (IHS) may include a hardware resource or an aggregate of hardware resources operable to compute, classify, process, transmit, receive, retrieve, originate, switch, store, display, manifest, detect, record, reproduce, handle, and/or utilize various forms of information, intelligence, or data for business, scientific, control, entertainment, or other purposes, according to one or more embodiments. For example, an IHS may be a personal computer, a desktop computer system, a laptop computer system, a server computer system, a mobile device, a tablet computing device, a personal digital assistant (PDA), a consumer electronic device, an electronic music player, an electronic camera, an electronic video player, a wireless access point, a network storage device, or another suitable device and may vary in size, shape, performance, functionality, and price. In one or more embodiments, a portable IHS may include or have a form factor of that of or similar to one or more of a laptop, a notebook, a telephone, a tablet, and a PDA, among others. For example, a portable IHS may be readily carried and/or transported by a user (e.g., a person). In one or more embodiments, components of an IHS may include one or more storage devices, one or more communications ports for communicating with external devices as well as various input and output (I/O) devices, such as a keyboard, a mouse, and a video display, among others. In one or more embodiments, IHS may include one or more buses operable to transmit communication between or among two or more hardware components. In one example, a bus of an IHS may include one or more of a memory bus, a peripheral bus, and a local bus, among others. In another example, a bus of an IHS may include one or more of a Micro Channel Architecture (MCA) bus, an Industry Standard Architecture (ISA) bus, an Enhanced ISA (EISA) bus, a Peripheral Component Interconnect (PCI) bus, HyperTransport (HT) bus, an inter-integrated circuit ($I^2C$) bus, a serial peripheral interface (SPI) bus, a low pin count (LPC) bus, an enhanced serial peripheral interface (eSPI) bus, a universal serial bus (USB), a system management bus (SMBus), and a Video Electronics Standards Association (VESA) local bus, among others.

In one or more embodiments, an IHS may include firmware that controls and/or communicates with one or more hard drives, network circuitry, one or more memory devices, one or more I/O devices, and/or one or more other peripheral devices. For example, firmware may include software embedded in an IHS component utilized to perform tasks. In one or more embodiments, firmware may be stored in non-volatile memory, such as storage that does not lose stored data upon loss of power. In one example, firmware associated with an IHS component may be stored in non-volatile memory that is accessible to one or more IHS components. In another example, firmware associated with an IHS component may be stored in non-volatile memory that may be dedicated to and includes part of that component. For instance, an embedded controller may include firmware that may be stored via non-volatile memory that may be dedicated to and includes part of the embedded controller.

An IHS may include a processor, a volatile memory medium, non-volatile memory media, an I/O subsystem, and a network interface. Volatile memory medium, non-volatile memory media, I/O subsystem, and network interface may be communicatively coupled to processor. In one or more embodiments, one or more of volatile memory medium, non-volatile memory media, I/O subsystem, and network interface may be communicatively coupled to processor via one or more buses, one or more switches, and/or one or more root complexes, among others. In one example, one or more of a volatile memory medium, non-volatile memory media, an I/O subsystem, a and network interface may be communicatively coupled to the processor via one or more PCI-Express (PCIe) root complexes. In another example, one or more of an I/O subsystem and a network interface may be communicatively coupled to processor via one or more PCIe switches.

In one or more embodiments, the term "memory medium" may mean a "storage device", a "memory", a "memory device", a "tangible computer readable storage medium", and/or a "computer-readable medium". For example, computer-readable media may include, without limitation, storage media such as a direct access storage device (e.g., a hard disk drive, a floppy disk, etc.), a sequential access storage device (e.g., a tape disk drive), a compact disk (CD), a CD-ROM, a digital versatile disc (DVD), a random access memory (RAM), a read-only memory (ROM), a one-time programmable (OTP) memory, an electrically erasable programmable read-only memory (EEPROM), and/or a flash memory, a solid state drive (SSD), or any combination of the foregoing, among others.

In one or more embodiments, one or more protocols may be utilized in transferring data to and/or from a memory medium. For example, the one or more protocols may include one or more of small computer system interface (SCSI), Serial Attached SCSI (SAS) or another transport that operates with the SCSI protocol, advanced technology attachment (ATA), serial ATA (SATA), a USB interface, an Institute of Electrical and Electronics Engineers (IEEE) 1394 interface, a Thunderbolt interface, an advanced technology attachment packet interface (ATAPI), serial storage architecture (SSA), integrated drive electronics (IDE), or any combination thereof, among others.

A volatile memory medium may include volatile storage such as, for example, RAM, DRAM (dynamic RAM), EDO RAM (extended data out RAM), SRAM (static RAM), etc. One or more of non-volatile memory media may include nonvolatile storage such as, for example, a read only memory (ROM), a programmable ROM (PROM), an erasable PROM (EPROM), an electrically erasable PROM, NVRAM (non-volatile RAM), ferroelectric RAM (FRAM), a magnetic medium (e.g., a hard drive, a floppy disk, a magnetic tape, etc.), optical storage (e.g., a CD, a DVD, a BLU-RAY disc, etc.), flash memory, a SSD, etc. In one or more embodiments, a memory medium can include one or more volatile storages and/or one or more nonvolatile storages.

In one or more embodiments, a network interface may be utilized in communicating with one or more networks and/or one or more other information handling systems. In one example, network interface may enable an IHS to communicate via a network utilizing a suitable transmission protocol and/or standard. In a second example, a network interface may be coupled to a wired network. In a third example, a network interface may be coupled to an optical network. In another example, a network interface may be coupled to a wireless network. In one instance, the wireless network may include a cellular telephone network. In a second instance, the wireless network may include a satellite telephone network. In another instance, the wireless network may include a wireless Ethernet network (e.g., a Wi-Fi network, an IEEE 802.11 network, etc.).

In one or more embodiments, a network interface may be communicatively coupled via a network to a network storage resource. For example, the network may be implemented as, or may be a part of, a storage area network (SAN), personal area network (PAN), local area network (LAN), a metropolitan area network (MAN), a wide area network (WAN), a wireless local area network (WLAN), a virtual private network (VPN), an intranet, an Internet or another appropriate architecture or system that facilitates the communication of signals, data and/or messages (generally referred to as data). For instance, the network may transmit data utilizing a desired storage and/or communication protocol, including one or more of Fibre Channel, Frame Relay, Asynchronous Transfer Mode (ATM), Internet protocol (IP), other packet-based protocol, Internet SCSI (iSCSI), or any combination thereof, among others.

In one or more embodiments, a processor may execute processor instructions in implementing at least a portion of one or more systems, at least a portion of one or more flowcharts, at least a portion of one or more methods, and/or at least a portion of one or more processes. In one example, a processor may execute processor instructions from one or more memory media in implementing at least a portion of one or more systems, at least a portion of one or more flowcharts, at least a portion of one or more methods, and/or at least a portion of one or more processes. In another example, a processor may execute processor instructions via a network interface in implementing at least a portion of one or more systems, at least a portion of one or more flowcharts, at least a portion of one or more methods, and/or at least a portion of one or more processes.

In one or more embodiments, a processor may include one or more of a system, a device, and an apparatus operable to interpret and/or execute program instructions and/or process data, among others, and may include one or more of a microprocessor, a microcontroller, a digital signal processor (DSP), an application specific integrated circuit (ASIC), and another digital or analog circuitry configured to interpret and/or execute program instructions and/or process data, among others. In one example, a processor may interpret and/or execute program instructions and/or process data stored locally (e.g., via memory media and/or another component of an IHS). In another example, a processor may interpret and/or execute program instructions and/or process data stored remotely (e.g., via a network storage resource).

In one or more embodiments, an I/O subsystem may represent a variety of communication interfaces, graphics interfaces, video interfaces, user input interfaces, and/or peripheral interfaces, among others. For example, an I/O subsystem may include one or more of a touch panel and a display adapter, among others. For instance, a touch panel may include circuitry that enables touch functionality in conjunction with a display that is driven by a display adapter.

A non-volatile memory medium may include an operating system (OS) and applications (APPs). In one or more embodiments, one or more of an OS and APPs may include processor instructions executable by a processor. In one example, a processor may execute processor instructions of one or more of OS and APPs via a non-volatile memory medium. In another example, one or more portions of the processor instructions of one or more of an OS and APPs may be transferred to a volatile memory medium and a processor may execute the one or more portions of the processor instructions.

Non-volatile memory medium may include information handling system firmware (IHSFW). In one or more embodiments, IHSFW may include processor instructions executable by a processor. For example, IHSFW may include one or more structures and/or one or more functionalities of and/or compliant with one or more of a basic input/output system (BIOS), an Extensible Firmware Interface (EFI), a Unified Extensible Firmware Interface (UEFI), and an Advanced Configuration and Power Interface (ACPI), among others. In one instance, a processor may execute processor instructions of IHSFW via non-volatile memory medium. In another instance, one or more portions of the processor instructions of IHSFW may be transferred to volatile memory medium, and processor may execute the one or more portions of the processor instructions of IHSFW via volatile memory medium.

In some information handling systems such as laptops, a cooling system may include one or more heatpipes for transferring heat from a component (e.g., a processor, a memory, a network interface, etc., as described above) to a heat exchanger. In a heatpipe, liquid driven by capillary force travels from a cool section (e.g., ear a heat exchanger) to a hot section (e.g., near a processor generating heat while processing information) within the wick and vapor moves in the opposite direction (e.g., from the hot section to the cool section) due to the pressure difference in the vapor cavity.

For example, referring to FIG. 1, an example heatpipe 100 generally comprises tube 102, wick 104 disposed within tube 102 and vapor cavity 106. Tube 102 may be flattened (e.g., compressed or otherwise configured to have two sides (illustrated as a top and a bottom in FIG. 1)) and wick 104 may be disposed in contact with one side of tube 102. A working fluid (not shown) in vapor form may transport heat in a first direction (e.g., into the page) and the working fluid in liquid form may travel an opposite direction (e.g., out of the page) to transfer heat from heat-generating component 108 to a heat exchanger.

As shown in FIG. 1, almost all wicking material is formed on an inner surface associated with a single side of tube 102. A drawback for a slim flat heatpipe 100 is that the space for the wick 104 and vapor cavity 106 is very limited due to the thin Z thickness of tube 102, resulting in a significant reduction in heat transferring capacity.

Figure 2:
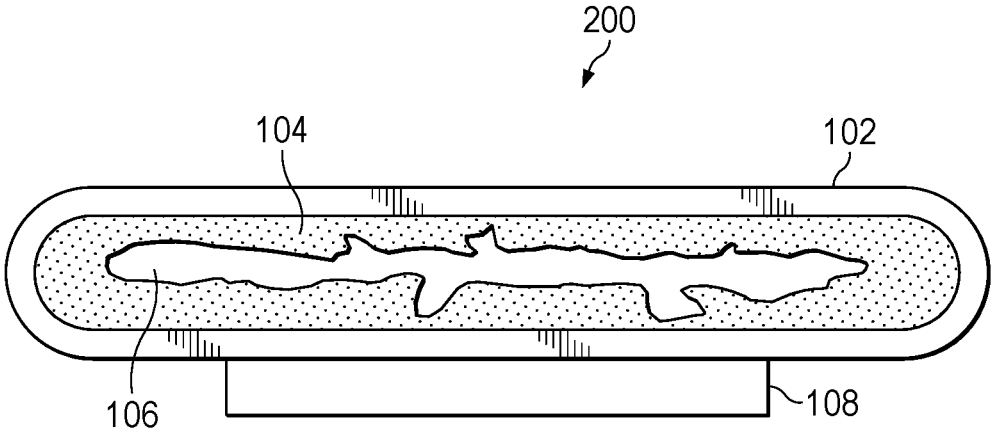
FIG. 2 depicts an example heatpipe with a wick formed in contact with both sides of a flattened tube, illustrating an occurrence in which a vapor cavity may be forced to receive heat from multiple areas of the wick.

Turning to FIG. 2, another example heatpipe 200 generally comprises tube 102, wick 104 formed by wicking material disposed in contact with all portions of an inner surface of tube 102 and vapor cavity 106. Tube 102 may be flattened (e.g., compressed or otherwise configured to have two sides (illustrated as a top and a bottom in FIG. 1)) and wick 104 may be disposed in contact with substantially the entire inner surface of tube 102. A working fluid (not shown) in vapor form may transport heat in a first direction (e.g., into the page) and the working fluid in liquid form may travel an opposite direction (e.g., out of the page) to transfer heat from heat-generating component 108 to a heat exchanger.

A drawback to heatpipe 200 may be that only a portion of wick 104 may efficiently transfer heat from component 108 to the working fluid.

Figure 3:
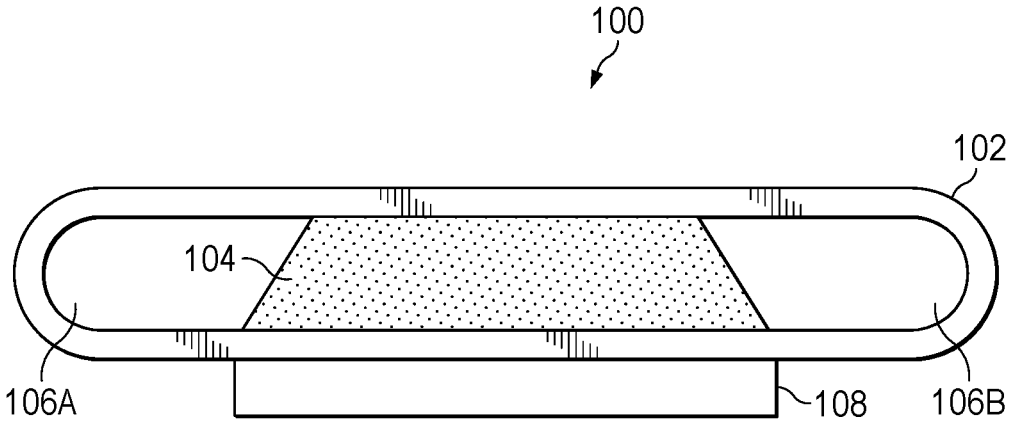
FIG. 3 depicts an example heatpipe with a wick formed in contact with both sides of a flattened tube divides the vapor cavity into two sections, illustrating an occurrence in which heat in the middle of the wick may be forced to travel some distance to reach one of the two sections of the vapor cavity.

Turning to FIG. 3, another example heatpipe 300 generally comprises tube 102, wick 104 disposed within tube 102 and a working fluid in vapor cavity 106. Tube 102 may be flattened (e.g., compressed or otherwise configured to have two sides (illustrated as a top and a bottom in FIG. 1) and wick 104 may be formed by wicking material disposed in contact with both sides of tube 102, dividing vapor cavity 106 into two vapor cavity areas 106A and 106B. In this design, wick 104 occupies the center part of tube 102 and separates vapor cavity 106 into two isolated areas. Although this design may reduce the vapor flow impedance (e.g., allowing more vapor to move in the same total vapor cavity area), vapor that is generated in the center area of wick 104 will be more difficult to leave wick 104.

Embodiments may effectively remove heat from components in a chassis, spread the heat across a width of a thin heatpipe and transfer heat longitudinally using ridges.

Embodiments disclosed herein may be generally directed to a thin heatpipe and a method for manufacturing a thin heatpipe, wherein the heatpipe comprises a wick formed as a plurality of longitudinal ridges, with each ridge extending from one inner surface of a tube in the direction of and in contact with the inner surface associated with an opposing side of the tube.

Figure 4:
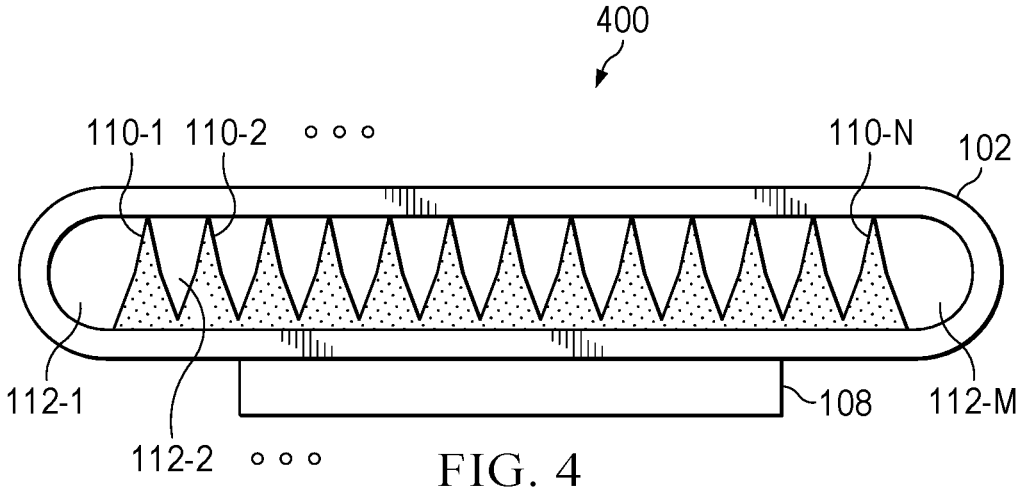
FIG. 4 depicts an example heatpipe in which a wick is formed with a base in contact with one side of a flattened tube and extending a height toward a second side to divide the vapor cavity into a plurality of small portions in accordance with some embodiments.

Turning to FIG. 4, embodiments disclosed herein may include a heatpipe 400 comprising tube 102 containing a wick formed as a plurality of ridges 110-1 to 110-N, wherein each ridge 110 may extend the length of heatpipe 400 and may have a cross-section configured to improve heat transfer from component 108 to a working fluid in one of a plurality of vapor cavity areas 112-1 to 112-M. For example, as depicted in FIG. 4, each ridge 110 may be formed for contact with an inner surface of tube 102 for efficient heat transfer from tube 102 to ridge 110. Each ridge 110 may extend from a first portion of the inner surface of tube 102 associated with a first side of tube 102 to contact a second portion of the inner surface of tube 102 associated with a second side of tube 102 opposite the first inner surface.

Each ridge 110 may comprise one or more sides to transfer heat to a vapor cavity area 112. Each side may be formed as a straight line or may be curved, angled, or otherwise shaped such that ridge 110 may efficiently transfer heat from component 108 to a working fluid in a vapor cavity area 112 of a plurality of vapor cavity areas 112-1 to 112-M. In some embodiments (not shown), one or more ridges 110 may be formed with curvilinear cross-section profiles, wherein ridges 110 may have only one side (e.g., a substantially circular cross-section profile, a semi-spherical cross-section profile, etc.). In some embodiments, one or more ridges 110 may be formed with rectilinear cross-section profiles, wherein ridges 110 may have two or more sides (e.g., a triangular cross-section profile, a rectangular cross-section profile, etc.). For example, FIG. 4 depicts an embodiment in which one or more ridges 110 have generally triangular cross-section profiles (e.g., a base in contact with a first inner surface of tube 102 and two sides extending from the base for contact with a second inner surface on an opposite side of tube 102), with each side having two sections of different lengths and/or angles.

In some embodiments, each ridge 110 may be in contact with an adjacent ridge 110. In other embodiments, a ridge 110 may be separated from an adjacent ridge 110 by a small gap (not shown).

A method for manufacturing heatpipe 400 may comprise using a mandrel to form a plurality of ridges 110 inside tube 102 and then flattening tube 102.

Figure 5:
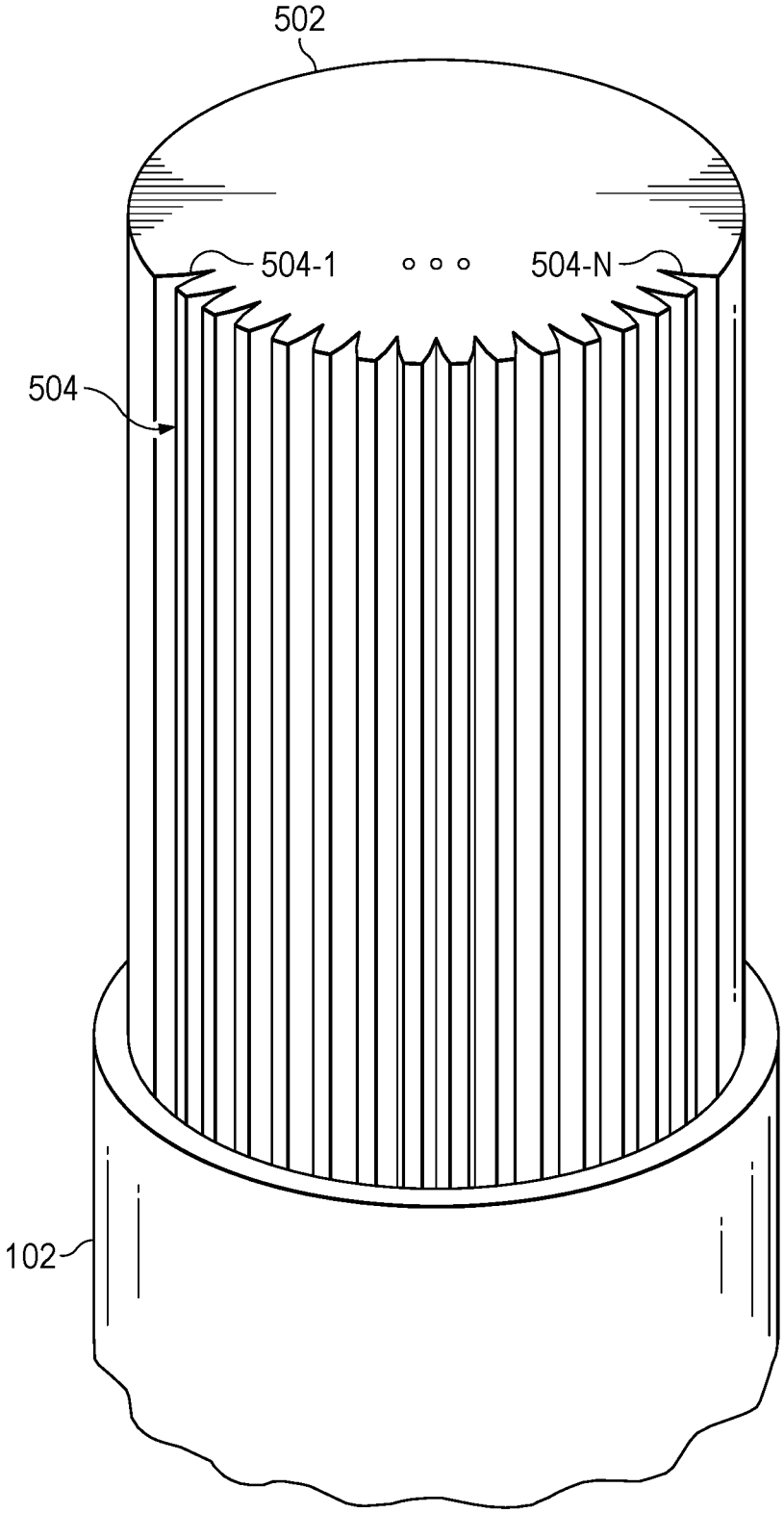
FIG. 5 depicts a partial perspective view of a tube with a mandrel being positioned in the tube, the mandrel having a plurality of indentations, illustrating a step in a method for manufacturing a thin heatpipe in accordance with some embodiments.

FIG. 5 is a partial perspective view of tube 102 with mandrel 502 partially positioned therein, wherein mandrel 502 may be used to form ridges 110. Mandrel 502 may be formed with a first portion of the outer surface comprising a generally continuous surface and a second portion of the outer surface comprising a plurality of indentations 504-1 to 504-N, each indentation 504 formed longitudinally along a length of mandrel 502 and corresponding to a ridge 110.

Figure 6:
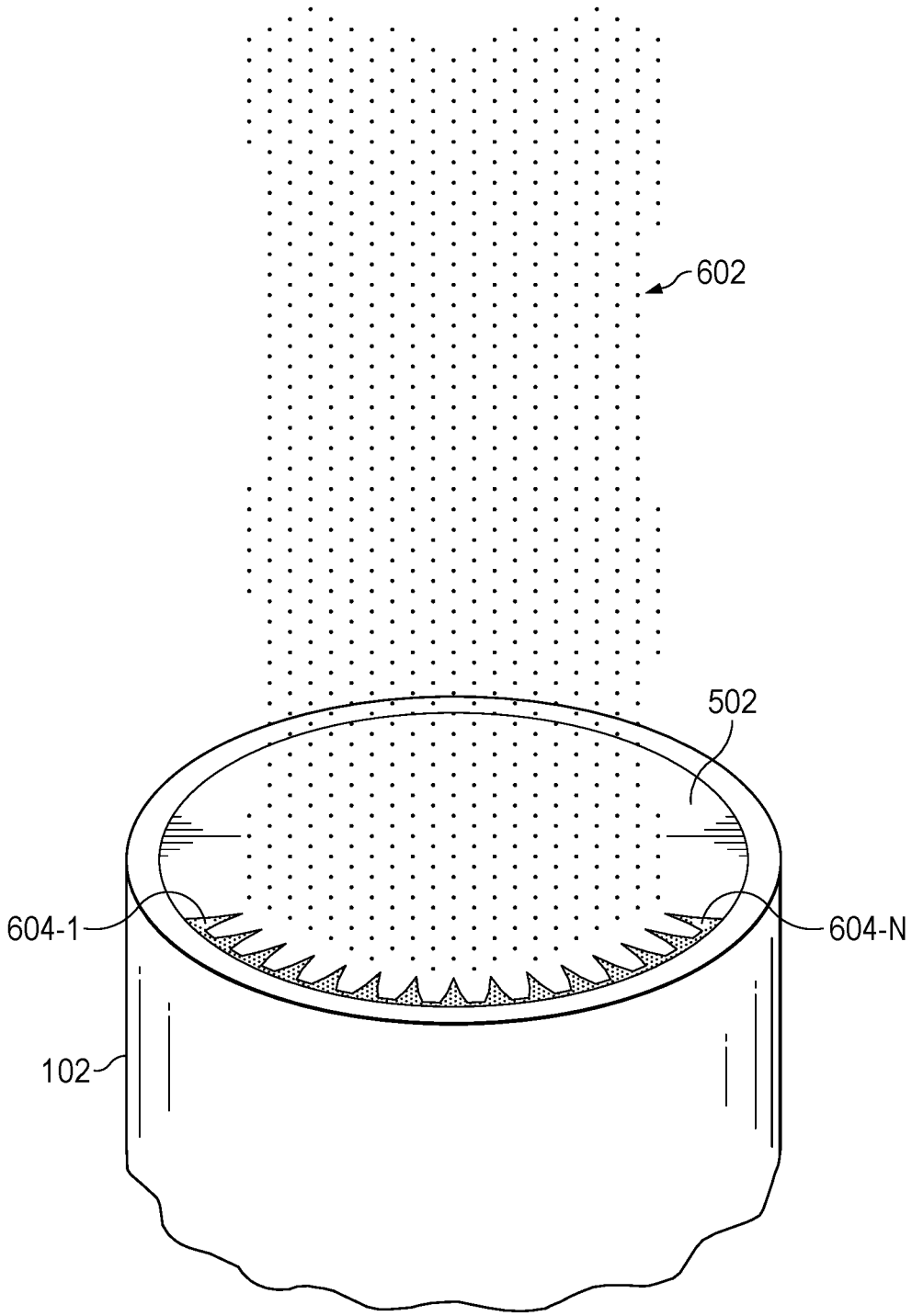
FIG. 6 depicts a partial perspective view of a tube with a mandrel positioned in the tube and wicking material added into space formed by the indentations and the inner surface of the tube, illustrating a step in a method for manufacturing a thin heatpipe in accordance with some embodiments.

FIG. 6 is a partial perspective view of tube 102 with mandrel 502 positioned therein and wick material 602 being disposed in cavities 604-1 to 604-N formed by an inner surface of tube 102 and indentations 504-1 to 504-N. Mandrel 502 may be sized such that wicking material 602 may be added only to cavities 604-1 to 604-N in tube 102.

Figure 7:
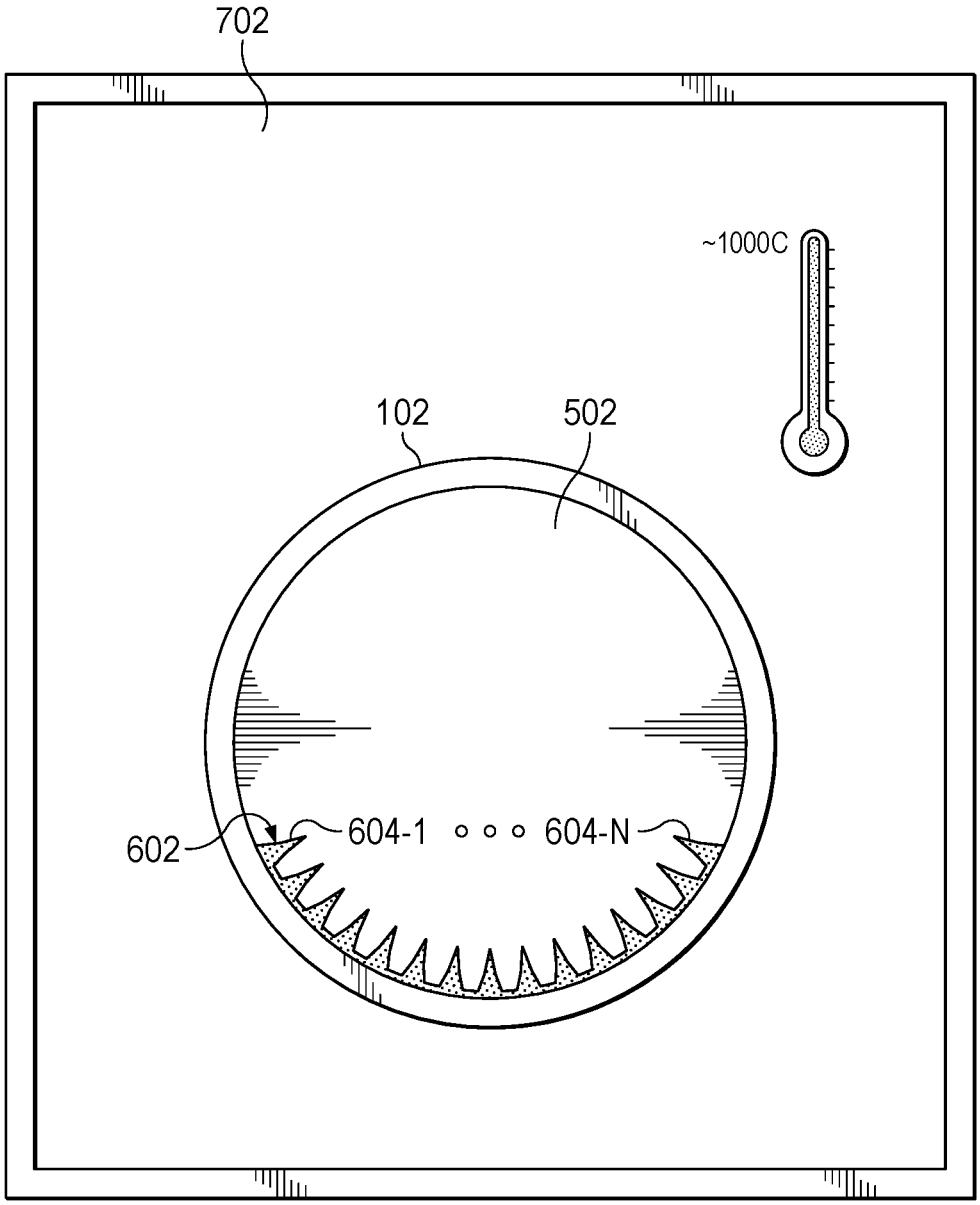
FIG. 7 depicts a front view of an oven or other heat source containing the tube of FIG. 6 with wicking material added into space formed by the indentations and the inner surface of the tube, illustrating a step in a method for manufacturing a thin heatpipe in accordance with some embodiments.

FIG. 7 is an end view of tube 102 in oven 702, with mandrel 502 positioned in tube 102 and wick material 602 disposed in cavities 604. Tube 102 may remain in oven 702 at a temperature sufficient to form ridges 110-1 to 110-N from wick material 602 in cavities 604-1 to 604-N. The temperature at which wick material 602 forms ridges 110-1 to 110-N is shown in FIG. 7 as approximately 1000 C. However, the temperature at which wick material forms ridges 110-1 to 110-N may depend on the type of wick material 602, the composition of wick material 602, the time that tube 102 is subjected to heat from oven 702, or some other factor. Accordingly, the temperature may be greater or less than 1000 C.

Figure 8:
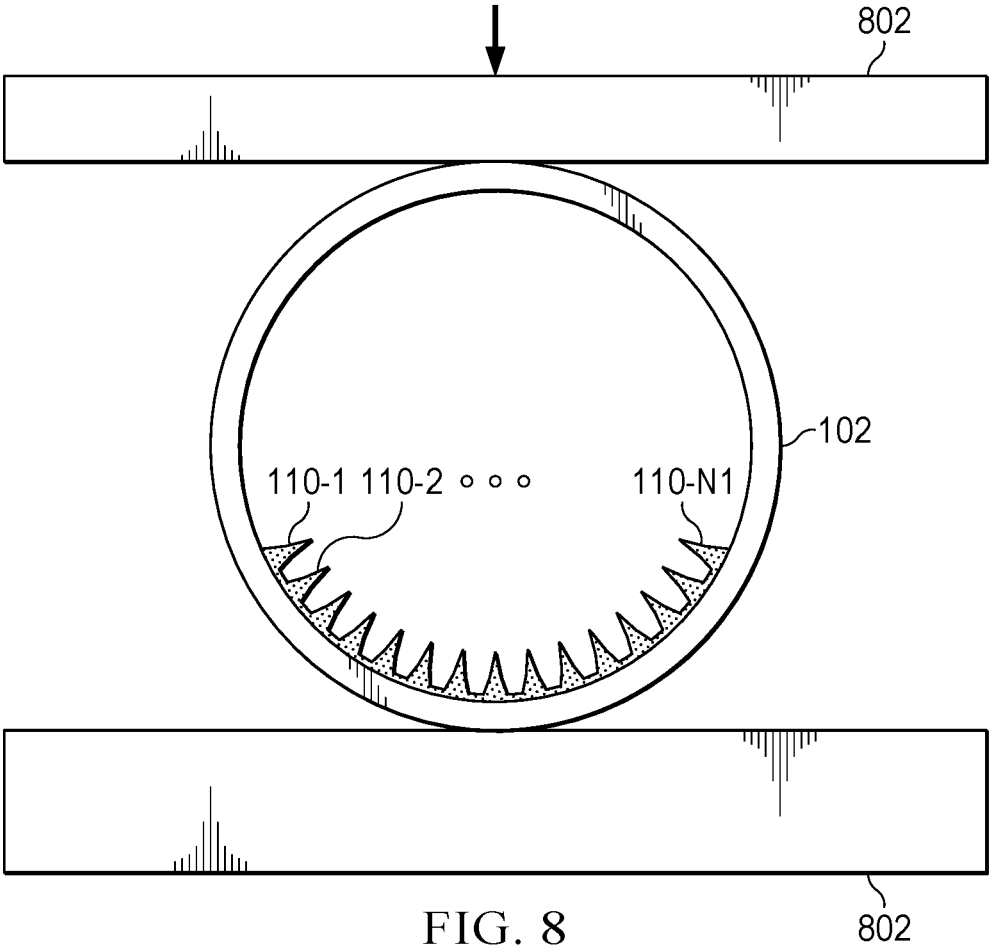
FIG. 8 depicts an end view of a tube with the mandrel removed and a press applying a force to flatten the tube, illustrating a step in a method for manufacturing a thin heatpipe in accordance with some embodiments.

FIG. 8 is an end view of tube 102 with mandrel 502 removed such that tube 102 contains a plurality of ridges 110-1 to 110-N in contact with a portion of the inner surface of tube 102. Tube 102 may be positioned in press 802, wherein press 802 may exert a force on tube 102 to flatten tube 102 into a thin shape with two opposing sides (e.g., a top side and a bottom side as viewed) and such that each ridge 110 is in contact with each inner surface. In some embodiments, tube 102 may be flattened to have a Z thickness less than 2 millimeters (mm). In some embodiments, tube 102 may be flattened to have a Z thickness less than 1.5 millimeters (mm).

Figure 9:
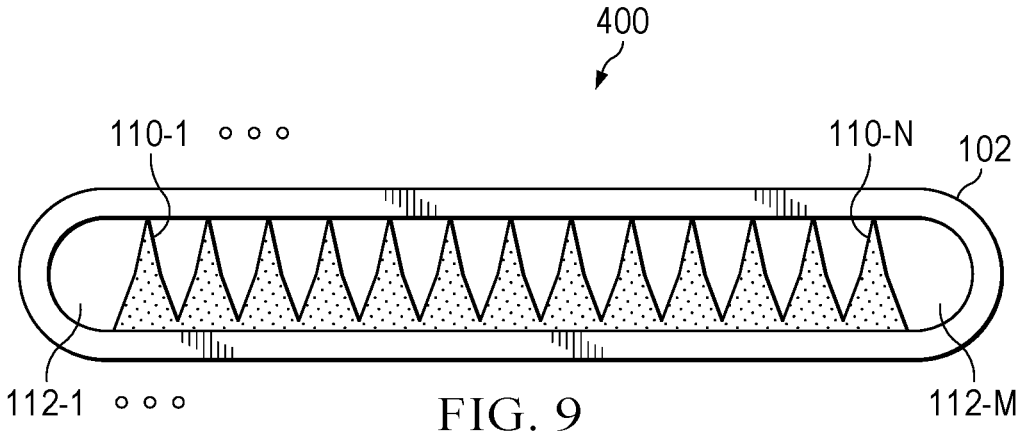
FIG. 9 depicts an end view of a tube with a working fluid added to the vapor cavity, illustrating the working fluid is able to flow longitudinally in a part of the vapor cavity, in accordance with some embodiments.

FIG. 9 is an end view of tube 102 compressed or otherwise configured to have two generally opposing sides, with a plurality of ridges 110-1 to 110-N in contact with a first portion of the inner surface of tube 102 associated with a first side of tube 102 and extending to contact a second portion of the inner surface of tube 102 associated with a second side of tube 102, wherein heatpipe 400 comprises a plurality of vapor cavity areas 112-1 to 112-M. Once tube 102 is flattened, a first end of tube 102 may be closed, a working fluid 902 may be added to vapor cavity 106 and a second end of tube 102 may be closed, forming heatpipe 400.

As depicted in FIG. 9 the number of vapor cavity areas 112 may be more than the number of ridges 110 (e.g., M is greater than N). In some embodiments one or both curved sections of tube 102 may further comprise a ridge such that the number of vapor cavity areas 112 may be less than the number of ridges 110 (e.g., M is less than N) or the number of vapor cavity areas 112 may be the same as the number of ridges 110 (e.g., M is equal to N).

Figure 10:
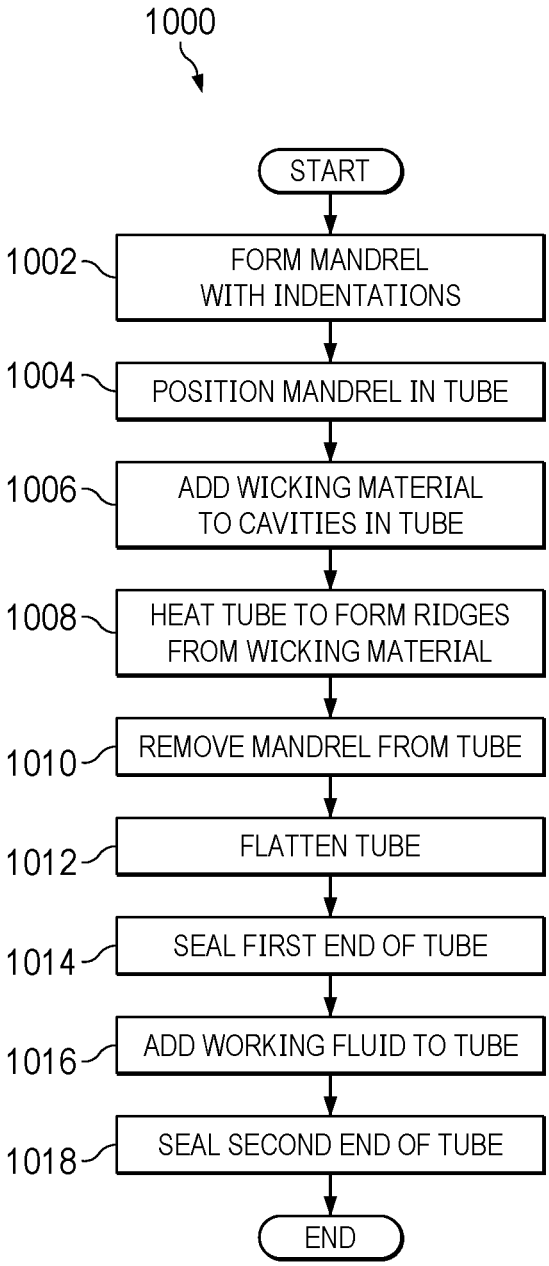
FIG. 10 depicts a flow diagram of a method for manufacturing one embodiment of a thin heatpipe having a plurality of longitudinal ridges.

FIG. 10 depicts a flow diagram illustrating a method for manufacturing a thin heatpipe 400 having a plurality of ridges 110.

At step 1002, mandrel 502 may be formed having a plurality of indentations 504-1 to 504-N. Each indentation 504 may be shaped based on an intended shape of a ridge 110.

At step 1004, mandrel 502 may be positioned in tube 102, wherein tube 102 may have a continuous inner surface and each indentation 504 in mandrel 502 is formed longitudinally along a length of mandrel 502.

At step 1006, wicking material 602 may be added to cavities 604-1 to 604-N formed by indentations 504 in mandrel 502.

At step 1008, tube 102 with wicking material 602 added to cavities 604 may be positioned in an oven or furnace, wherein the oven or furnace heats the wicking material 602 to a temperature that causes wicking material 604 to form ridges 110.

At step 1010, tube 102 may be removed from the oven and mandrel 502 may be removed from tube 102, leaving a plurality of ridges 110 on a portion of the inner surface of tube 102.

At step 1012, tube 102 may be flattened until the inner surface corresponding to a first side of tube 102 contacts the plurality of ridges 110.

At step 1014, a first end of tube 102 may be sealed.

At step 1016, a working fluid may be added to tube 102.

At step 1018, a second end of tube 102 may be sealed, forming heatpipe 400 with a plurality of ridges 110-1 to 110-N arranged longitudinally and dividing vapor cavity 106 into a plurality of vapor cavity areas 112-1 to 112-M, wherein M may be more than, less than, or the same number as N.

Although not shown, heatpipe 400 may be positioned in a chassis of an information handling system, wherein the first end of heatpipe 400 may be positioned near a processor or other heat-generating component or subsystem and the second end may be positioned near a heat exchanger such that heatpipe 400 forms part of a cooling system for transporting heat out of the chassis.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

What is claimed is:

1. A heatpipe comprising:

a hollow tube forming a vapor cavity, wherein the tube comprises two opposing sides;

a wick formed in the tube, the wick comprising a plurality of ridges, each ridge formed longitudinally on an inner surface of the tube and comprising a base in contact with a first portion of the inner surface and two sides extending for contact with a second portion of the inner surface, wherein the first portion is associated with a first side of the tube and the second portion is associated with a second side of the tube opposite the first side and the plurality of ridges divides an interior of the tube into a plurality of vapor cavity areas, wherein each ridge comprises a triangular cross-section profile with each side of each ridge having a first linear section and a second linear section, wherein, for each ridge of the plurality of ridges, the second linear section of each side extends from the first linear section of the same side such that the second linear section of each side converge together at the second portion of the inner surface, wherein, for at least one ridge of the plurality of ridges and for at least one side of the at least one ridge, a first length of the first linear section of the side differs from a second length of the second linear section of the side, and the first linear section extends linearly at a first angle with respect to the first portion of the inner surface of the hollow tube and the second linear section extends linearly at a second angle with respect to the first linear section, the second angle differing from the first angle; and a working fluid in the plurality of vapor cavity areas.

2. The heatpipe of claim 1, wherein a ridge of the plurality of ridges is in contact with an adjacent ridge of the plurality of ridges.

3. The heatpipe of claim 1, wherein a ridge of the plurality of ridges is separated from an adjacent ridge of the plurality of ridges by a gap.

4. The heatpipe of claim 1, wherein the plurality of ridges are formed by sintering the wicking material.

5. A cooling system for an information handling system, the cooling system comprising:

a heat exchanger; and a heatpipe having a first end thermally coupled to a heat-generating component of the information handling system and a second end thermally coupled to the heat exchanger, wherein the heatpipe comprises:

a hollow tube with an inner surface, wherein the tube is flattened to form two opposing sides;

a wick formed in the tube, the wick comprising a plurality of ridges, each ridge formed longitudinally within the tube and comprising a base in contact with a portion of the inner surface associated with a first side of the two opposing sides and each ridges extends to contact a portion of the inner surface associated with a second side of the two opposing sides, the plurality of ridges dividing an interior of the tube into a plurality of vapor cavity areas, wherein each ridge comprises a triangular cross-section profile with each side of each ridge having a first linear section and a second linear section, wherein, for each ridge of the plurality of ridges, the second linear section of each side extends from the first linear section of the same side such that the second linear section of each side converge together at the second portion of the inner surface, wherein, for at least one ridge of the plurality of ridges and for at least one side of the at least one ridge, a first length of the first linear section of the side differs from a second length of the second linear section of the side, and the first linear section extends linearly at a first angle with respect to the first portion of the inner surface of the hollow tube and the second linear section extends linearly at a second angle with respect to the first linear section, the second angle differing from the first angle; and a working fluid in the plurality of vapor cavity areas.

6. The cooling system of claim 5, wherein a ridge of the plurality of ridges is in contact with an adjacent ridge of the plurality of ridges.

7. The cooling system of claim 5, wherein a ridge of the plurality of ridges is separated from an adjacent ridge of the plurality of ridges by a gap.

* * * * *